United States Patent [19]

Manhart

[11] Patent Number: 4,480,788

[45] Date of Patent: Nov. 6, 1984

[54] SNOW GUN

[76] Inventor: Michael Manhart, Hinterwies, 6764 Lech a, Arlberg, Austria

[21] Appl. No.: 425,180

[22] Filed: Sep. 28, 1982

[30] Foreign Application Priority Data

Jan. 18, 1982 [EP] European Pat. Off. ..... 82200057.6

[51] Int. Cl.[3] ..... F25C 3/04

[52] U.S. Cl. ..... 239/14; 239/433

[58] Field of Search ..... 239/14, 429, 430, 431, 239/432, 433

[56] References Cited

U.S. PATENT DOCUMENTS

| | | | |
|---|---|---|---|
| 2,613,737 | 10/1952 | Schwietert | 239/431 X |
| 2,676,471 | 4/1954 | Pierce, Jr. | 239/25 |
| 3,650,476 | 3/1972 | Rackley et al. | 239/432 X |
| 3,831,844 | 8/1974 | Tropeano et al. | 239/14 |
| 4,343,434 | 8/1982 | Haruch | 239/432 X |
| 4,383,646 | 5/1983 | Smith | 239/430 X |

*Primary Examiner*—Andres Kashnikow
*Assistant Examiner*—Mary F. McCarthy
*Attorney, Agent, or Firm*—Zarley, McKee, Thomte, Voorhees & Sease

[57] ABSTRACT

The compressed-air supply line of the snow gun passes through the center of the pressurized-water supply line, thus bounding an annular chamber between them. Inner nozzles forming part of the air line interconnect the two supply lines. The compressed-air supply line opens out into an interior space within the spray head, this space being bounded at the front end by a perforated end piece. For the purpose of reducing the expenditure of energy for a given homogeneity of the air-water mixture, the radial width of the annular chamber in the vicinity of the inner nozzles is from one to three times greater than the diameter of an imaginary bore whose area corresponds to the total area of all inner nozzle bores, divided by three.

6 Claims, 1 Drawing Figure

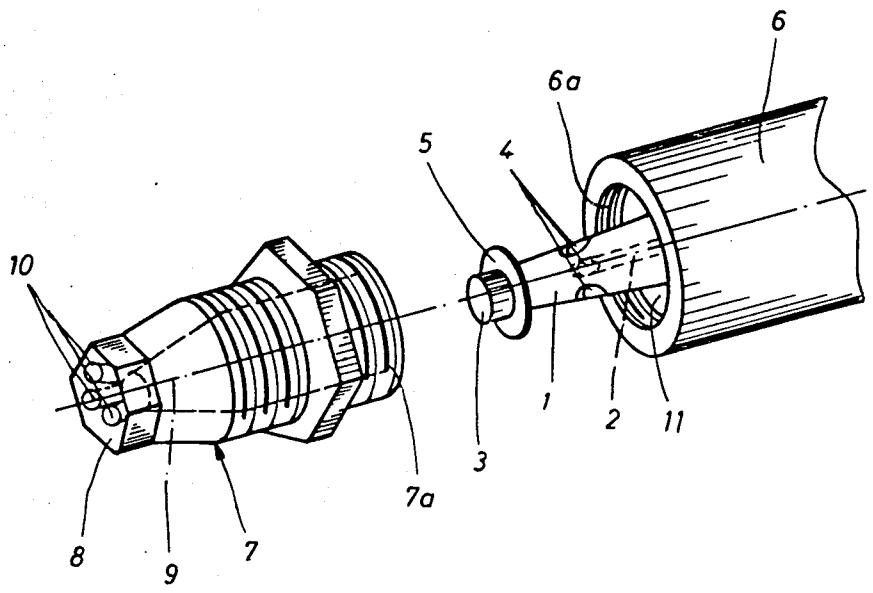
6
6a
4
5
11
2
1
3
7a
7
9
8
10

SNOW GUN

This invention relates to apparatus for making and distributing snow, and more particularly to a snow gun of the type having a central compressed-air supply line and a pressurized-water supply line disposed coaxially with and surrounding the compressed-air supply line, by which two supply lines an annular chamber is bounded, the two supply lines being interconnected by inner nozzles of the compressed-air supply line, and the compressed-air supply line opening out into an interior space, bounded at the front in the direction of the compressed-air feed by a perforated end piece, of a spray head.

The mode of operation of such a snow gun is essentially that a very low temperature develops in the interior space, whereupon condensation nuclei are formed in the air-water mixture as ice particles about which the water already partially freezes into snow.

Such prior art snow guns have the decisive drawback that a sufficient degree of mixing of the compressed air and the pressurized water can be achieved only by means of a comparatively large expenditure of energy. The result of an inadequate mixture of air and water for a given expenditure of energy is that the use of snow guns becomes questionable whenever a sufficient supply of energy is not available.

Any waste of energy is all the more intolerable in connection with snow guns as considerable energy must in any case be applied in order to activate the cold potential of the ambient air as much as possible by means of a large throwing range.

It is therefore an object of this invention to provide an improved snow gun by means of which a substantially better mixture of compressed air and pressurized water can be achieved with the same expenditure of energy as heretofore, or a mixing ratio as attainable with prior art snow guns can be produced using much less energy.

To this end, in the snow gun according to the present invention, of the type initially mentioned, the radial width of the wall of the annular chamber in the region of the inner nozzles is 1 to 3 times greater than the diameter of an imaginary bore, the area of which corresponds to the total area of all inner bores divided by 3. The imaginary bore, as the term is used herein, is an equivalent area having one-third the total cross-sectional area of all the inner bores 4.

A preferred embodiment of the invention will now be described in detail with reference to the accompanying drawing, which is a partial perspective view showing the spray head unscrewed and moved slightly away from the pressurized-water supply line for the sake of clarity.

A compressed-air duct 2, connected to a source of compressed air (not shown) by any suitable means, passes through inside a compressed-air supply line 1. Duct 2 is closed at its front end by a plug 3. On the other hand, three lateral inner nozzle bores 4 are provided which communicate with duct 2, and the geometric or central axes of which intersect the geometric or central axis of duct 2 at an acute angle, preferably of less than 15 degrees. Adjacent to plug 3 is a baffle plate 5 which stands out perpendicular to the geometric or central axis of duct 2.

Disposed coaxially with compressed-air supply line 1 is the jacket 6 of a pressurized-water supply line. An internal thread 6a of jacket 6 receives an external thread 7a of a spray head 7. As a result of this arrangement, an annular chamber 11 is created between air supply line 1 and jacket 6 of the water line. Thus, the radial width of annular chamber 11 is naturally equivalent to the distance, measured along a radius, between the inside wall of jacket 6 and the outside wall of supply line 1. Furthermore, the dimensions are such that the radial width of chamber 11 in the region of inner nozzles 4 is 1 to 3 times greater than the diameter of an imaginary bore having an area corresponding to the total area of all inner nozzle bores 4 divided by three as stated above.

This relationship is expressed mathematically in the following equations 1 and 2:

$$l = n \cdot d_F \tag{1}$$

$$A_F = (n_i A_i)/3 \tag{2}$$

where $l$ = the radial width of the wall of the annular chamber at the inner nozzles $n$ = a number from 1 to 3

$n_i$ = the number of inner bores $d_F$ = the diameter of the imaginary bore $r_F$ = the radius of the imaginary bore $A_F$ = the area of the imaginary bore $d_i$ = the diameter of one inner nozzle $r_i$ = the radius of one inner nozzle $A_i$ = the cross-sectional area of one inner nozzle Given that $A_i = \pi r_i^2$ and $r_i = d_i/2$, equation 2 can be restated as indicated in equation 3, expression (a), (b) and (c). The equation 4 is the mathematical statement of the area of the imaginery bore.

$$A_F = \underbrace{\frac{n_i A_i}{3}}_{(a)} = \underbrace{\frac{n_i(\pi r_i^2)}{3}}_{(b)} = \underbrace{\frac{n_i \pi \left(\frac{d_i}{2}\right)^2}{3}}_{(c)} = \frac{n_i \pi d_i^2}{3 \cdot 4} \tag{3}$$

$$A_F = \pi r_F^2 = \frac{\pi d_F^2}{4} \tag{4}$$

Substituting the equation 4 into equation 3 yields equation 5 and solving for $d_F$ yields equation 6.

$$\frac{\pi d_F^2}{4} = \frac{n_i \pi d_i^2}{3 \cdot 4} \tag{5}$$

$$d_F = \sqrt{\frac{4 \pi n_i d_i^2}{4 \pi 3}} = \sqrt{\frac{n_i d_i^2}{3}} = d_i \sqrt{\frac{n_i}{3}} \tag{6}$$

Substituting equation 6 into equation 1 yields equation 7 and substituting $2r_i$ for $d_i$ yields equation 8 which is set forth in the independent claim appended hereto.

$$l = n d_i \sqrt{\frac{n_i}{3}} \tag{7}$$

$$l = 2 n r_i \sqrt{\frac{n_i}{3}} \tag{8}$$

Moreover, the radial width of annular chamber 11 in the region of baffle plate 5 corresponds at least approximately to that in the region of inner nozzle 4.

When spray head 7 is screwed on, its inside wall together with an end piece 8 bound an interior space 9 communicating with the outside atmosphere via three perforations 10, none of which is situated on the geometric or central axis of compressed-air supply line 1. Instead of the three perforations 10, any desired plurality of apertures might basically be provided, none of which must be situated on the geometric or central axis of supply line 1, however.

The mode of operation of the snow gun according to the foregoing embodiment of the invention differs from that of the prior art snow guns, as described earlier, in that, as measurements have shown, the expenditure of energy for achieving an intimate mixture of compressed air and pressurized water is considerably less.

What is claimed is:

1. A snow gun comprising, a central compressed-air supply line, a pressurized-water supply line having a central axis disposed coaxially with and surrounding said compressed-air supply line, an annular chamber bounded by said compressed-air supply line and said pressurized-water supply line, two or more inner nozzles forming part of said compressed-air supply line and interconnecting the two said supply lines, said inner nozzles having central axes forming an acute angle with the central axis of said pressurized water supply line, a spray head attached at one end thereof to said pressurized-water supply line and including an interior space, and a perforated end piece attached to the other end of said spray head and bounding said interior space, said compressed-air supply line opening out into said interior space, wherein the radial width of said annular chamber in the vicinity of said inner nozzles satisfies the equation $$l = 2nr_i\sqrt{n_i/3}$$

wherein l is the said radial width, n is a number from 1 to 3, $n_i$ is the number of said inner nozzles, and $r_i$ is the radius of said inner nozzles.

2. The snow gun of claim 1, wherein the geometric axes of said inner nozzles form an acute angle with the geometric axis of said compressed-air supply line.

3. The snow gun of claim 2, wherein said acute angle is of less than 15 degrees.

4. The snow gun of claim 1, further comprising a baffle plate disposed in said annular chamber, rigidly connected to and projecting out at right angles to the geometric axis of said compressed-air supply line.

5. The snow gun of claim 4, wherein said radial width of said annular chamber is substantially the same in the vicinity of said baffle plate as in the vicinity of said inner nozzles.

6. The snow gun of claim 5, wherein the distance between the inner face of said end piece bounding said interior space and the face of said baffle plate nearest said end piece is equal to from twice to ten times the diameter of one of said inner nozzles.

* * * * *